US007503083B2

(12) United States Patent
Ball

(10) Patent No.: US 7,503,083 B2
(45) Date of Patent: Mar. 17, 2009

(54) MEANS FOR COVERING THE FLANGE OF A WASTE WATER STRAINER

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 530 days.

(21) Appl. No.: 11/161,933

(22) Filed: Aug. 23, 2005

(65) Prior Publication Data

US 2007/0044218 A1 Mar. 1, 2007

(51) Int. Cl.
*A47K 1/14* (2006.01)

(52) U.S. Cl. ..... 4/650; 4/286; 285/46; 285/332.2

(58) Field of Classification Search ..... 4/286, 4/650, 652, 287, 288; 285/46, 55, 139.2, 285/192, 206, 332.2, 332.3
See application file for complete search history.

(56) References Cited

U.S. PATENT DOCUMENTS 820,437 A * 5/1906 Pehrson ..... 285/332.3 X
3,345,085 A * 10/1967 Hanes ..... 285/332.2 X
3,380,081 A 4/1968 Eilertson et al.
3,615,984 A * 10/1971 Chase ..... 285/55 X
5,265,281 A * 11/1993 McAlpine ..... 4/287
5,418,983 A * 5/1995 Garguillo et al. ..... 4/287
5,535,455 A * 7/1996 Liu ..... 4/287
5,692,248 A 12/1997 Ball
5,745,931 A 5/1998 Ball

* cited by examiner

*Primary Examiner*—Robert M Fetsuga
(74) *Attorney, Agent, or Firm*—Sheridan Ross P.C.

(57) ABSTRACT

A waste water insert has a cylindrical wall surrounding a vertical cylindrical bore. A horizontal flange extends outwardly from the upper end of the wall and has a lip formed on its outer periphery. The horizontal flange of the waste water insert is super-imposed over the horizontal flange of a waste water strainer located in a bathtub, sink or the like. The cylindrical wall of the insert extends downwardly through the cylindrical wall of the waste water strainer with the two walls being spaced from each other by virtue of the cylindrical wall of the insert having a smaller diameter than that of the strainer. One or more grooves are within the cylindrical wall of the insert and receive resilient rings that engage the cylindrical wall of the strainer.

5 Claims, 3 Drawing Sheets

MEANS FOR COVERING THE FLANGE OF A WASTE WATER STRAINER

BACKGROUND OF THE INVENTION

A strainer in the plumbing field is the mechanism in the bottom of a sink, bathtub, or the like through which waste water flows from the receptacle. Strainers usually have valves or the like which control the flow of water therethrough. Most of these valve assemblies are threadably mounted within a threaded aperture located in the strainer.

Existing strainers have a vertically disposed externally threaded sleeve which engage corresponding threads on a fitting adjacent a vertically disposed aperture in the bottom of the water receptacle. The upper end of the sleeve terminates in a circular horizontal flange which engages and is sealed to the bottom of the receptacle around the aperture in the bottom of the receptacle. A hub with a threaded bore and with radially extending spokes is often located in a horizontal plane in the bottom of the strainer to support various closure valves.

Occasionally it is necessary to change the strainer of a given receptacle because the flange thereof has become tarnished, disfigured, or because the flange is incompatible esthetically with the owner's sense of ornamentation. Removal of the strainer is often a difficult task, particularly when the strainer has been in place for a long time. Conventional tools are typically insufficient for use in removal of the strainer. Further, there is a possibility that the threads of the replacement strainer will not be compatible with the threads of the fitting or bushing associated with the aperture of the receptacle. In addition, when the strainer is removed there is nothing to retain the back drain system and it falls away.

Some attempts have been made to place a substitute flange over the existing flange by providing structure whereby the substitute flange can be threadably secured to threaded bores of the strainer which originally threadably received the valve assembly of the strainer. This approach to the installation of a substitute flange is not satisfactory because variations of thread sizes in the original strainers are often incompatible with the thread sizes of the substituted flange adapter.

It is therefore a principal object of this invention to provide a means for covering the flange of an existing strainer without removing the existing strainer.

A further object of this invention is to provide a means for covering the flange of an existing strainer which will permit easy installation, and which will be well within the ability of those not being skilled in the plumbing art.

These and other objects will be apparent to those skilled in the art.

BRIEF SUMMARY OF THE INVENTION

A waste water insert has a cylindrical wall surrounding a cylindrical bore. A flange extends outwardly from the upper end of the wall and has a lip formed on its outer periphery.

The flange of the waste water insert is superimposed over the flange of a waste water strainer located in a bathtub, sink or the like. The lip at the outer perimeter of the flange of the insert fits over the outer periphery of the horizontal flange of the waste water strainer to center the insert on the strainer. The cylindrical wall of the insert extends downwardly through the cylindrical wall of the waste water strainer with the two walls being spaced from each other by virtue of the cylindrical wall of the insert having a smaller diameter than that of the strainer. The cylindrical wall of the strainer extends below the cylindrical wall of the insert, and has a lower circular edge. One or more grooves are positioned within the cylindrical wall of the insert that receive one or more resilient ring members that engage the cylindrical wall of the strainer.

DETAILED DESCRIPTION OF THE PREFERRED EMBODIMENT

The numeral 10 designates a fluid compartment or receptacle such as a tub or a sink. Compartment 10 has a bottom 12 with an interior bottom surface 14. A waste water aperture 16 is located in bottom 12.

Figure 1:
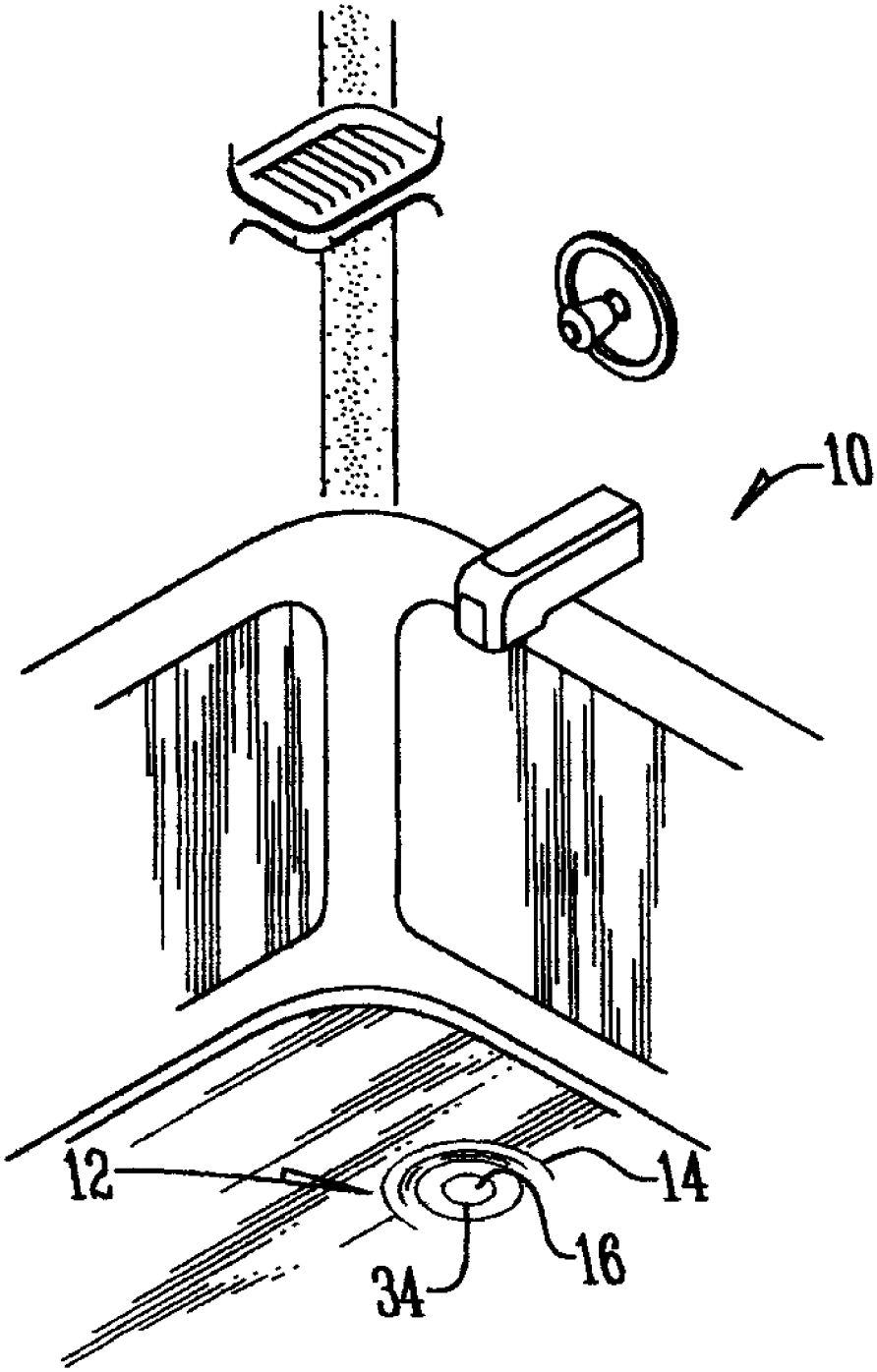
FIG. 1 is a partial perspective view of a bathtub with a waste water strainer located in the bottom thereof.
Figure 2:
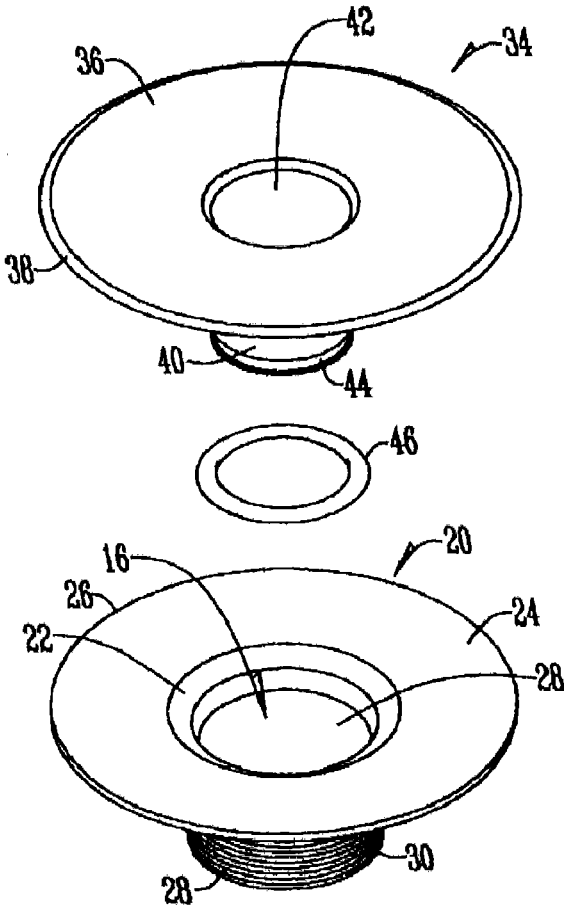
FIG. 2 is an exploded view showing a preliminary step in mounting the waste water insert onto the existing waste water strainer.

A waste water strainer 20 is shown in FIG. 2. Strainer 20 has an upper end 22 from which a circular flange 24 extends. The outer perimeter 26 of flange 24 engages the interior bottom surface 14 (FIG. 1) surrounding aperture 16. The strainer 20 has a downwardly extending cylindrical wall 28 and external threads 30. The typical closure valves which may be associated with strainer 20 have not been shown.

Figure 3:
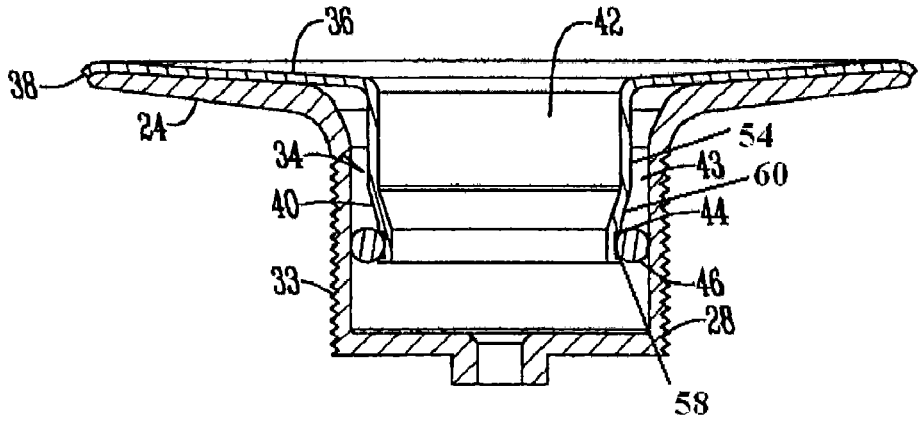
FIG. 3 is an unexploded cross sectional view of the assembly shown in FIG. 2.

The numeral 34 designates a waste water insert. Insert 34 has a flange 36 with the periphery thereof terminating in a downwardly extending lip 38. As best shown in FIG. 3, the lip 38 extends downwardly and over the outer perimeter 26 of flange 24 of strainer 20. The lip 38 engages the bottom 12 of compartment 10 when installed.

Insert 34 has a downwardly extending wall 40 which surrounds a center opening 42. The diameter of wall 40 is less than the diameter of the cylindrical wall 28 of strainer 20 so that a space 43 (FIGS. 3 and 4) exists between the two walls. The lip 38 on the outer perimeter of the flange 36 of insert 34 centers the cylindrical wall 40 within the cylindrical wall 28 of strainer 20 (FIG. 3). In one embodiment, the waste water insert 34 includes a wall 40 with a cylindrical first portion 54 and a cylindrical second portion 58 with a conical portion 60 therebetween. The diameter of the cylindrical first portion 54 is greater than the diameter of the cylindrical second portion 58 such that the space 43 is reduced adjacent to the cylindrical first portion 54.

The cylindrical wall 40 extends downwardly and has a first groove 44 in the lower end. The groove 44 receives a resilient ring member 46 that engages the cylindrical wall 28 of the strainer 20 to hold the insert 34 in place. In one embodiment, the resilient ring member 46 is an O-ring.

Figure 4:
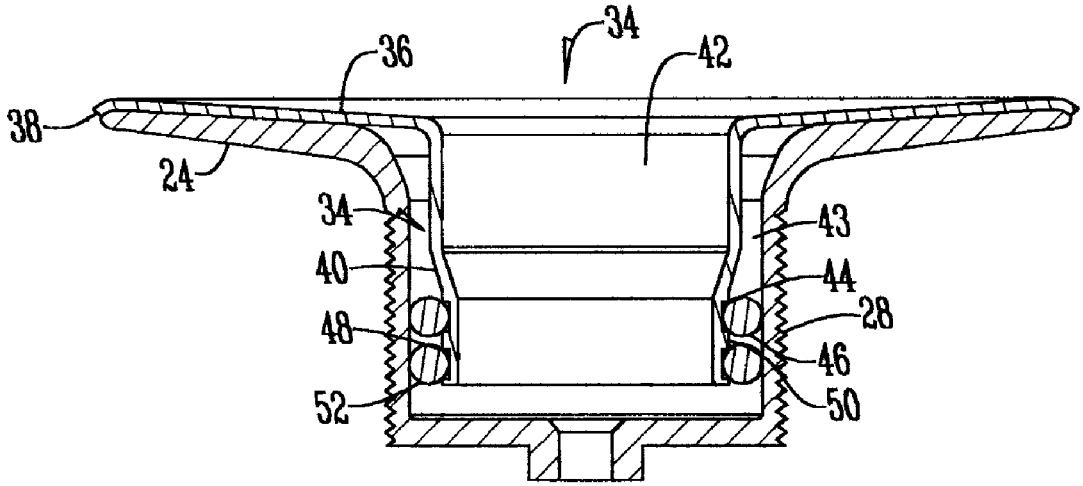
FIG. 4 is an enlarged scale sectional view similar to that of FIG. 3 showing a modified form of insert.

Alternatively, the waste water insert 34, as shown in FIG. 4, has a second groove 48 in spaced relation to the first groove 44 with a raised surface 50 therebetween. The second groove 48 receives a second resilient ring member 52 that also engages the cylindrical wall 28 of strainer 20. Additional grooves and rings may be added as desired.

The insert is installed by inserting the cylindrical wall 40 of the insert 34 into the opening 16 (FIG. 2) of the strainer 20 until the insert is in place. At this point the resilient ring or rings of the insert will engage the cylindrical wall 28 of the strainer 20 to hold the insert 34 in place. No tools are required and the inserts are quickly, easily, and securely installed to achieve their required purpose.

It will be appreciated by those skilled in the art that other various modifications could be made to the device without the parting from the spirit in scope of this invention. All such modifications and changes fall within the scope of the claims and are intended to be covered thereby.

What is claimed is:

1. In combination with a fluid compartment having a bottom with a waste water strainer mounted in said bottom, said strainer having a cylindrical wall with a bottom edge surrounding a cylindrical opening extending through the bottom of said compartment, and a flange extending outwardly from a level above and adjacent said cylindrical opening and positioned on the bottom of said compartment:

a waste water insert comprising a wall with a cylindrical first portion and a cylindrical second portion with a conical portion therebetween, said cylindrical first portion having a diameter greater than a diameter of said cylindrical second portion, said wall surrounding a cylindrical bore and having an upper end, and a flange on said upper end extending outwardly from said cylindrical bore;

the wall of said insert being spaced from cylindrical wall of said strainer wherein said cylindrical first portion being closer to said cylindrical wall of said strainer than said cylindrical second portion;

and the cylindrical second portion of said insert receiving a resilient ring that engages said cylindrical wall of said strainer.

2. The combination of claim 1 wherein said resilient ring is an O-ring.

3. The combination of claim 1 wherein said insert has a groove that receives the resilient ring.

4. The combination of claim 3 wherein said insert includes a second groove for receiving a second resilient ring that engages the cylindrical wall of said strainer.

5. The combination of claim 1 wherein said flange of said insert rests on the flange of said strainer, and said wall extends downwardly into the cylindrical opening of said strainer.

* * * * *